United States Patent [19]

Schwarz

[11] 3,979,496

[45] Sept. 7, 1976

[54] METHOD OF IMPARTING LATENT CRIMP IN POLYOLEFIN SYNTHETIC FIBERS

[76] Inventor: Eckhard C. A. Schwarz, 115 N. Park Ave., Neenah, Wis. 54956

[22] Filed: Jan. 9, 1976

[21] Appl. No.: 647,829

Related U.S. Application Data

[63] Continuation-in-part of Ser. No. 434,314, Jan. 17, 1974, Pat. No. 3,949,041.

[52] U.S. Cl. ..... 264/168; 264/210 F; 264/290 R

[51] Int. Cl.[2] ..... D01D 5/22

[58] Field of Search ..... 264/290 R, 210 F, 168; 57/140 J

[56] References Cited

UNITED STATES PATENTS 2,296,394 9/1942 Meloon ..... 57/140 J

*Primary Examiner*—Jay H. Woo

*Attorney, Agent, or Firm*—Henry C. Fuller

[57] ABSTRACT

In a non-friction texturing process, the filaments of a thermoplastic polymer yarn are heated along spaced zones to form a latent crimp in the filament. The filaments are then drawn and are subsequently heated above the glass transition temperature of the polymer while the filaments are under low enough tension to allow the crimp to form. The heating along spaced zones is preferably accomplished by passing the filaments over a heated rotating grooved roll.

11 Claims, 4 Drawing Figures

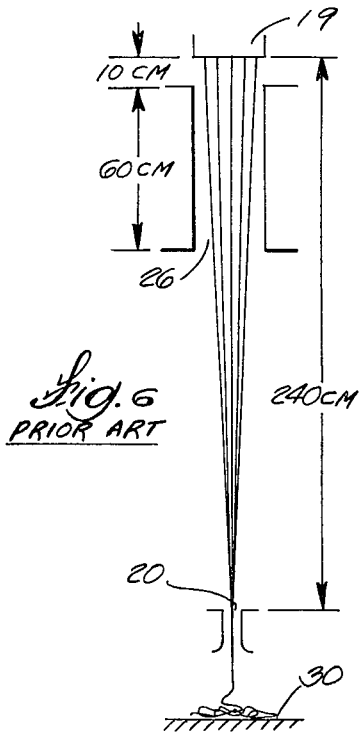
Fig. 6
PRIOR ART
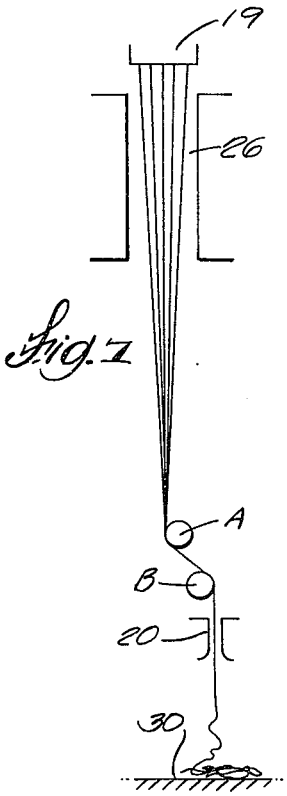
Fig. 7
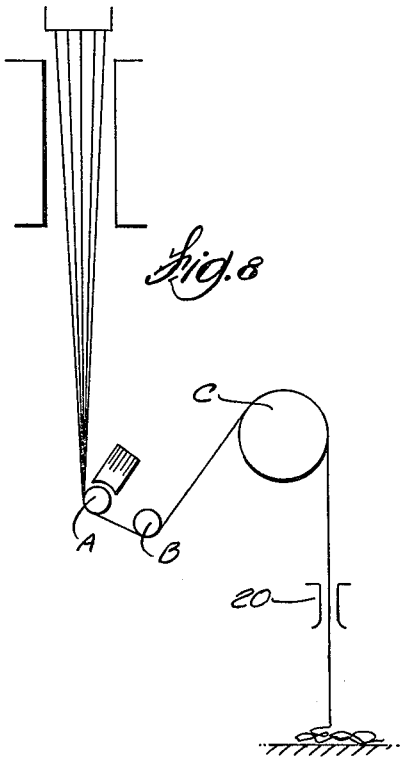
Fig. 8
Fig. 9
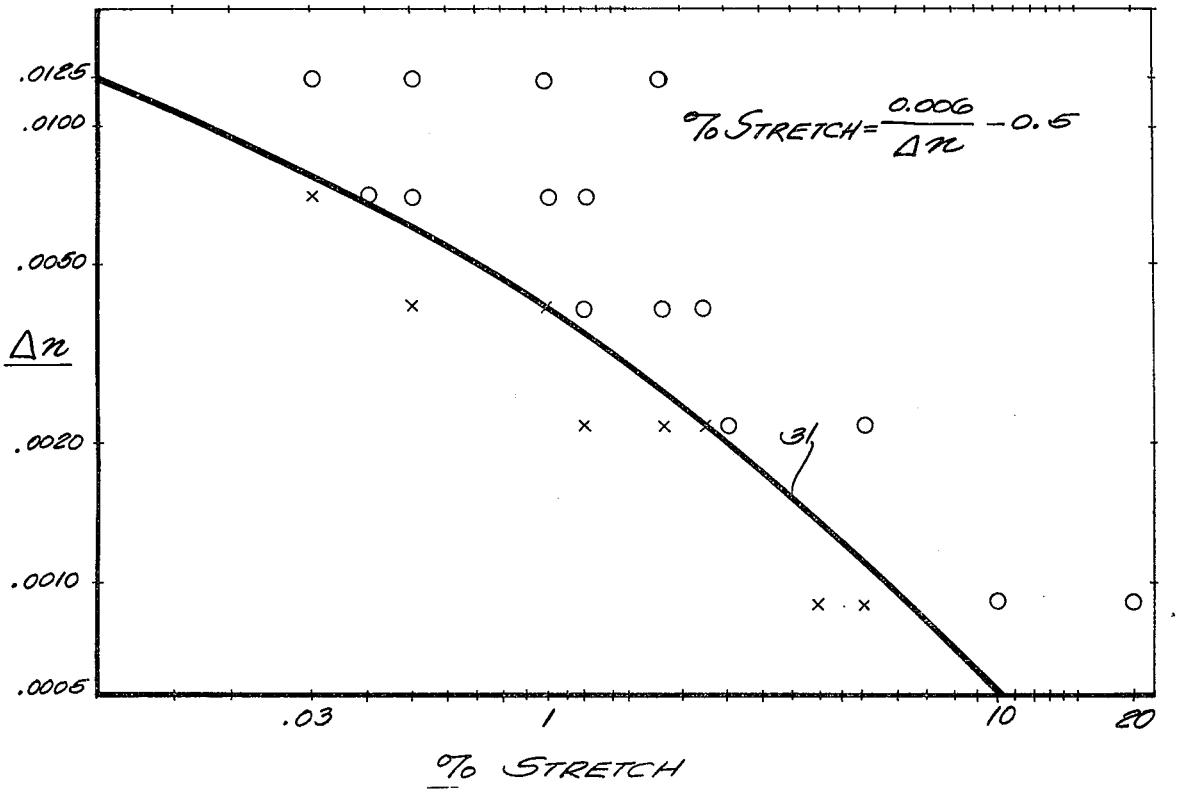

METHOD OF IMPARTING LATENT CRIMP IN POLYOLEFIN SYNTHETIC FIBERS

CROSS REFERENCE TO RELATED APPLICATION

This application is a continuation-in-part application of copending U.S. application Ser. No. 434,314, filed Jan. 17, 1974, now U.S. Pat. No. 3,949,041, the entire disclosure of which is incorporated herein by reference.

BACKGROUND OF THE INVENTION

This invention relates to a crimped continuous filament yarn, having enhanced bulk level, and for a process of making such yarn. More particularly, this invention relates to a process at high speed giving excellent crimp uniformity and regularity.

In my patent application Ser. No. 434,314 an undrawn or partially drawn yarn is guided over a heated grooved roll allowing a specific contact time, which is related to the filament denier, and then drawn. The combination of heating for a critical time and draw produces the latent crimp. This phenomenon is discussed in the above application on page 10, lines 1–19.

SUMMARY OF INVENTION

Whereas, in the above application crimp is produced at a rather high draw ratio, the present invention deals with crimp at low draw ratios of melt-oriented yarns having specific orientation properties. While at higher draw ratios (1.05 and up) latent crimp can be produced by this method in unoriented yarns having extremely low birefringence. At lower draw ratios, latent crimp is produced only if the yarn has a certain amount of preorientation before heating for a critical time and subsequently drawing it.

It is believed that in a partially oriented fiber, such as high speed melt-oriented fiber, the crystallization process has already started and is in a stage, where rate of crystallization can be very fast at certain temperatures. Crystallization rate is further enhanced by minor amounts of tension and stretch. This explains why a completely amorphous and unoriented fiber, where crystal nucleation has not yet started, does not respond at very low levels of elongation and tension to form a latent crimp by this method. A further distinction in this invention is the fact that the yarn is stretched without the help of pairs of goudet rolls. The tension over the heated groove roll is sufficient to stretch the yarn to low draw ratios after it leaves the roll, as subsequently described.

The grooved roll can be replaced by a smooth heated roll, in which case the regular periodic crimp is converted into a spiral crimp. Critical contact time on the roll with regard to crimp intensity, however, is the same.

DESCRIPTION OF DRAWINGS

FIGS. 1 to 5 are illustrated and described in said copending application Ser. No. 434,314, now U.S. Pat. No. 3,949,041.

FIG. 6 is a diagrammatic view of a prior art filament spinning process.

FIG. 7 is a diagrammatic view of apparatus for practicing the process of the invention.

FIG. 8 is a further diagrammatic view of apparatus for practicing the process of the invention.

FIG. 9 is a curve showing birefringence and elongation interrelation based on data from Table 11.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

FIG. 6 of the drawings shows the unmodified spinning line. having a spinnerette 19, a quench zone 26 and an air jet drawing filaments down and depositing them on a screen. This technique has been thoroughly described in U.S. Pat. No. 3,692,618 by Dorschner et al. FIG. 7 shows the improvement of this invention.

The air jet 20 is pulling filaments off the spinnerette 19 over a grooved roll A (FIG. 4) or a smooth heated roll A and a cold guide roll B. At high spinning speeds, molecular orientation is imparted in the quench zone 26. Heating the filaments over roll A for a specific time causes the filaments to yield or stretch to some extent between roll A and B, which results in the formation of a latent crimp, which can then be developed by heating the filaments above their glass transition temperature. The extent of yield or stretch between the freely rotating rolls A and B is measured by determining the rotations per minute (RPM) of the rolls with a stroboscope. From the RPM and the roll diameter, the yarn speed can be calculated, and from the yarn velocity and the spinning rate, the denier and denier per filament (dpf) can be calculated. Denier can also be measured on the product deposited on the screen 30. Thus, roll B is not an essential part of this invention with regard to forming latent crimp, but is used to conveniently determine stretch ratios which is necessary to understand the important parameters of this invention.

If a draw jet is used to draw down the yarn, yarn speed is determined by the interaction of spinneret temperature, quench efficiency, spinning rate and jet air pressure. In FIG. 8, speed of roll C determines positively the velocity of the filament as it leaves roll A. The stretch between rolls A and B is again measured with a stroboscope.

FIGS. 2 and 3 show the position of the filaments over the grooved roll A. FIG. 4 is a perspective view of the grooved roll and FIG. 5 shows schematically the relation of velocity, denier, roll speed and size, and stretch.

The yarn 2 is coming onto the grooved roll with the velocity $V_1$ and denier $d_1$. The roll turns with the velocity $V_1$ on the surface. The contact time on the surface of the grooved roll is determined by the velocity $V_1$, the roll radius R, and the wrap angle $\alpha$, at point 6 the yarn is drawn off and yield to a velocity $V_2$, and the denier is consequently reduced to $d_2$.

To produce a latent crimp in a crystallizable synthetic fiber, it has been found that the contact time on the grooved roll has to be within a critical range. The critical contact time is dependent on the dpf: the higher the dpf, the longer the contact time has to be. The examples show that contact time $t$ should be within 0.00001 and 0.001 times the dpf in seconds. It is further necessary that the temperature of the roll A be above a certain limit. The upper limit is determined by the point where the roll causes melting of the yarn. Furthermore, it was found that the filaments have to have a minimum of molecular orientation as measured by the fiber birefringence in order to develop crimp at the low stretch ratios used in this invention. Further details will become apparent from the following examples:

EXAMPLE 1

In this example, polypropylene of melt flow rate 35 (Exxon CD 523) was extruded through a 32 hole spinnerette. Quench air of 70°F and 0.8 m/sec. velocity was used. The spinning rate and air jet pressure was changed as indicated to give a variety of yarn speeds, deniers and roll A contact times. Best crimp development was observed at a $t$/dpf value of about $10^{-4}$ seconds. Crimping efficiency was evaluated by examining the crimp developed upon heating in an oven at 160°C for 30 seconds. The yarn was freely suspended and under no tension. During this heating, shrinkage of the filaments as well as contraction due to the developed crimped occurred. "Texturing intensity" or "Crimp development" was rated by measuring the extended length of the heated yarn sample, and then letting the yarn contract back into its crimped state while under a tension of 0.01 gram per denier. Contraction is then calculated as percent of extended length. Crimp development is defined as follows:

0 = no crimp development
1 = very slight crimp, crimped length = 99–95% of extended length
2 = slight crimp, 90 –95%
3 = marginal crimp, 80 –90%
4 = good crimp, 65 –80%
5 = excellent crimp, less than 65%

EXAMPLE 2

In this example the jet pressure was varied at constant spinning rate to result in various degrees of stretch at the optimum $t$/dpf range. At very low levels of stretch, crimp development is less intense. Extrusion and spinning conditions were identical to example 1, Exxon polypropylene CD 523 was used as in Example 1. Groove distance of roll A in Example 1 and 2 was 230 micron. Roll diameter of roll A and B = 1 inch.

EXAMPLE 3

This example is a rerun of Example 1, but using as roll A a smooth roll with a surface finish of 20 micro inches. Optimum crimp development was in the same range as in Example 1 with regard to $t$/dpf.

EXAMPLE 4

In this example the temperature of roll A (1 inch diameter, grooves at 230 micron distance) was varied from room temperature to 700°F. There was no stretch or crimp development at room temperature; crimp development became noticeable at 150°F. Polymer and spinning conditions were identical to Example 1.

EXAMPLE 5

Polymer and extrusion conditions were as in Example 1; spinnerette temperature and quench air temperature were changed to result in filaments of varying degrees of birefringence, at higher spinnerette and quency air temperature yarn velocity increased and denier decreased, however, the $t$/dpf value remained in the optimum range. Crimp development became very low at less than 0.0055 birefringence.

Examples 1–5 were run with the spinning arrangement as indicated in FIG. 6 using polypropylene; Examples 6–8 were run using the system as shown in FIG. 7. Polyethylene therephaphate of 0.65 intrinsic viscosity was used as the polymer. The extrusion spinnerette had 48 holes of 0.020 inches diameter.

Roll A = grooves at 230 micron distance

EXAMPLE 6

This example is the equivalent of Example 1 for polyester, establishing the same optimum range for $t$/dpf.

EXAMPLE 7

This example is the equivalent of Example 4 for polyester, showing the effect of roll A temperature in crimp development.

EXAMPLE 8

This example is the equivalent of Example 5 for polyester; quench air temperature was changed to result in filaments of different birefringence. At very low birefringence, no crimp development is seen.

EXAMPLE 1

| Experiment No: | 1 | 2 | 3 | 4 | 5 | 6 | 7 | 8 |
|---|---|---|---|---|---|---|---|---|
| Spinnerette Temperature, °F | 550 | | | | | | | |
| Spinning Rate, gram/min | 40.4 | 27.0 | 13.3 | | 141.0 | 13.8 | 5.02 | 2.13 |
| Quench air temperature °F | 70 | | | | | | | |
| Yarn velocity (roll "A") m/min | 3931 | 1859 | 2344 | 3931 | 5484 | 2602 | 1016 | 362.7 |
| Yarn velocity (roll "B") m/min | 4004 | 1896 | 2387 | 3969 | 5646 | 2660 | 1073 | 362.7 |
| Roll A, RPM | 49140 | 23240 | 29300 | 49140 | 68550 | 32520 | 12700 | 4177 |
| Roll B, RPM | 50050 | 23700 | 29840 | 49620 | 70580 | 33250 | 13410 | 4534 |
| % stretch | 1.85 | 1.97 | 1.84 | 0.97 | 2.96 | 2.24 | 5.59 | 8.54 |
| Roll A Temperature °F | 450 | | | | | | | |
| Draw jet air psi | 25 | 30 | 25 | 25 | 41 | 25 | 18 | 12 |
| denier per filament (on roll "A") ("dpf") | 2.89 | 4.08 | 1.60 | 2.89 | 7.23 | 1.49 | 1.39 | 1.79 |
| wrap angle (over roll "A"), degree | 60 | 60 | 30 | 30 | 30 | 60 | 90 | 90 |
| contact length, cm | 1.33 | 1.33 | 0.66 | 0.66 | 0.66 | 1. | 2.00 | 2.00 |
| contact time, sec. $\cdot 10^{-4}$ ("t") | 2.03 | 4.29 | 1.69 | 1.01 | 0.72 | 3.07 | 11.81 | 35.9 |

-continued

| Experiment No: | 1 | 2 | 3 | 4 | 5 | 6 | 7 | 8 |
|---|---|---|---|---|---|---|---|---|
| t/dpf · $10^{-4}$ | 0.70 | 1.05 | 1.05 | 0.35 | 0.10 | 2.06 | 8.50 | 20.01 |
| Birefringence (Δn) | 0.0090 | .0070 | .0080 | .0090 | .0100 | .0080 | .0075 | .0065 |
| Crimp Development | 4 | 5 | 5 | 3 | 1 | 3 | 1 | 0 |

EXAMPLE 2

| Experiment No: | 1 | 2 | 3 | 4 | 5 | 6 |
|---|---|---|---|---|---|---|
| Spinnerette Temperature, °F. | 550 → | | | | | |
| Spinning Rate, gram/min | 32.0 | 32.0 | 32.0 | 32.0 | 32.0 | 32.0 |
| Quench air temperature °F | 70 | | | | | |
| Yarn velocity (roll "A") m/min | 6049 | 5287 | 4221 | 3130 | 2510 | 2046 |
| Yarn velocity (roll "B") m/min | 6358 | 5467 | 4328 | 3167 | 2533 | 2054 |
| Roll A, RPM | 75610 | 66090 | 52760 | 39120 | 31380 | 25580 |
| Roll B, RPM | 79480 | 68350 | 54100 | 39580 | 31670 | 25680 |
| % stretch | 5.11 | 3.41 | 2.53 | 1.17 | 0.92 | 0.39 |
| Roll A Temperature °F | 450 → | | | | | |
| Draw jet air, psi | 60 | 51 | 40 | 25 | 18 | 12 |
| denier per filament (on roll "A") (dpf) | 1.49 | 1.70 | 2.13 | 2.88 | 3.59 | 4.40 |
| wrap angle (over roll "A") (degree) | 60 → | | | | | |
| contact length, cm | 1.33 → | | | | | |
| contact time, sec. · $10^{-4}$ ("t") | 1.32 | 1.51 | 1.89 | 2.54 | 3.18 | 3.90 |
| t/dpf · $10^{-4}$, sec. | 0.89 → | | | | | |
| Birefringence (Δ n) | 0.0150 | 0.120 | .0100 | .0095 | .0080 | .0065 |
| Crimp Development | 5 | 4 | 4 | 2 | 1 | 0 |

EXAMPLE 3

| Experiment No: | 1 | 2 | 3 | 4 |
|---|---|---|---|---|
| Spinnerette Temperature, °F | 550 → | | | |
| Spinning Rate, gram/min | 41.0 | 28.7 | 139.0 | 5.10 |
| Quency air temperature °F | 70 → | | | |
| Yarn velocity (roll "A") m/min | 3854 | 2040 | 5484 | 1022 |
| Yarn velocity (roll "A") m/min | 3930 | 2078 | 5640 | 1077 |
| Roll A, RPM | 48180 | 25500 | 68550 | 12775 |
| Roll B, RPM | 49120 | 25980 | 70500 | 13460 |
| % stretch | 1.95 | 1.88 | 2.85 | 5.40 |
| Roll A temperature °F | 450 → | | | |
| Draw jet air, psi | 25 | 30 | 40 | 17 |
| denier per filament (on roll "A") ("dpf") | 2.99 | 3.96 | 7.12 | 1.40 |
| wrap angle (over roll "A") (degree) | 60 | 60 | 30 | 90 |
| contact length, cm | 1.33 | 1.33 | 0.66 | 2.00 |
| contact time, sec. · $10^{-4}$ ("t") | 2.07 | 3.91 | 0.72 | 11.74 |
| t/dpf · $10^{-4}$ | 0.69 | 0.99 | 0.10 | 8.39 |
| Birefringence (Δ n) | .0090 | .0070 | .0100 | .0075 |
| Crimp Development | 4 | 5 | 1 | 0 |

EXAMPLE 4

| Experiment No: | 1 | 2 | 3 | 4 | 5 | 6 |
|---|---|---|---|---|---|---|
| Spinnerette Temperature, °F | 500 → | | | | | |
| Spinning Rate, gram/min | 27.6 → | | | | | |
| Quench air temperature °F | 70 → | | | | | |
| Yarn velocity (roll "A") m/min | 2510 → | | | | | |
| Yarn velocity (roll "B") m/min | 2510 | 2511 | 2518 | 2525 | 2574 | 2624 |
| Roll A, RPM | 31380 → | | | | | |
| Roll B, RPM | 31380 | 31390 | 31470 | 31560 | 32170 | 32800 |
| % stretch | 0 | 0.03 | 0.28 | 0.57 | 2.51 | 4.52 |
| Roll A Temperature °F | 70 | 100 | 150 | 200 | 400 | 700 |
| Draw jet air, psi | 50 → | | | | | |
| denier per filament (on roll "A") ("dpf") | 3.10 → | | | | | |
| wrap angle (over roll "A") (degree) | 60 → | | | | | |
| contact length, cm | 1.33 → | | | | | |

-continued

| Experiment No: | 1 | 2 | 3 | 4 | 5 | 6 |
|---|---|---|---|---|---|---|
| contact time, sec. · $10^{-4}$ ("t") | 3.18 → | | | | | |
| t/dpf · $10^{-4}$ | 1.03 → | | | | | |
| Birefringence (Δ n) | 0.0090 | .0090 | .0085 | .0080 | .0075 | .0070 |
| Crimp Development | 0 | 0 | 1 | 2 | 3 | 5 |

EXAMPLE 5

| Experiment No: | 1 | 2 | 3 | 4 |
|---|---|---|---|---|
| Spinnerette Temperature, °F | 500 | 550 | 600 | 650 |
| Spinning Rate, gram/min | 23.6 | | | |
| Quench air temperature °F | 50 | 200 | 400 | 600 |
| Yarn velocity (roll "A") m/min | 1626 | 1854 | 2688 | 4016 |
| Yarn velocity (roll "B") m/min | 1671 | 1902 | 2773 | 4159 |
| Roll A, RPM | 20324 | 23180 | 33600 | 50200 |
| Roll B, RPM | 20890 | 23770 | 34660 | 51990 |
| % stretch | 2.80 | 2.54 | 3.15 | 3.56 |
| Roll A Temperature °F | 450 | | | |
| Draw jet air, psi | 40 | 40 | 35 | 30 |
| denier per filament (on roll "A") ("dpf") | 4.08 | 3.58 | 2.47 | 1.65 |
| wrap angle (over roll "A") (degree) | 60 | | | |
| contact length, cm | 1.33 | | | |
| contact time, sec. · $10^{-4}$("t") | 4.91 | 4.30 | 2.97 | 1.99 |
| t/dpf · $10^{-4}$ | 1.20 | 1.20 | 1.20 | 1.20 |
| Birefringence (Δ n) | 0.0120 | .0100 | .0055 | .0012 |
| Crimp Development | 4 | 2 | 1 | 0 |

EXAMPLE 6

| | Polyester, 48 hole spinnerette | | | | | | |
|---|---|---|---|---|---|---|---|
| Experiment No: | 1 | 2 | 3 | 4 | 5 | 6 | 7 |
| Spinnerette Temperature, °F | 610 → | | | | | | |
| Spinning Rate gram/min | 211.5 | 106.3 | 91.4 | 64.0 | 56.7 | 42.5 | 17.1 |
| Quench air temperature, °F | 70 → | | | | | | |
| Yarn velocity (roll "A") m/min | 6200 | 5500 | 4450 | 4120 | 3510 | 3200 | 3020 |
| Yarn velocity (roll "B") m/min | 6231 | 5549 | 4504 | 4182 | 3577 | 3289 | 3164 |
| Roll A and B diameter, inches | 1 | 1 | 1 | 1 | 1 | 3 | 3 |
| Roll A, RPM | 77500 | 68750 | 55620 | 51500 | 43880 | 1333 | 1258 |
| Roll B, RPM | 77890 | 69370 | 56300 | 52270 | 44710 | 1373 | 1318 |
| Roll C, m/min | 6232 | 5550 | 4506 | 4184 | 3580 | 3290 | 3168 |
| % stretch | 0.5 | 0.9 | 1.2 | 1.5 | 1.9 | 2.8 | 4.8 |
| Roll A Temperature °F | 600 → | | | | | | |
| denier per filament (on roll "A") ("dpf") | 6.39 | 3.63 | 3.85 | 2.91 | 3.03 | 2.49 | 1.06 |
| wrap angle (over roll "A") | 30 | 60 | 90 | 90 | 160 | 160 | 160 |
| contact length, cm | 0.66 | 1.33 | 2.00 | 2.00 | 3.55 | 10.64 | 10.64 |
| contact time, sec. · $10^{-4}$ ("t") | 0.64 | 1.45 | 2.70 | 2.91 | 6.07 | 19.95 | 21.14 |
| t/dpf · $10^{-4}$ | 0.10 | 0.40 | 0.70 | 1.0 | 2.0 | 8.0 | 20.0 |
| Birefringence (Δ n) | 0.0120 | .0120 | .0100 | .0100 | .0100 | .0090 | .0090 |
| Crimp Development | 1 | 1 | 3 | 5 | 2 | 1 | 0 |

EXAMPLE 7

| | Polyester, 48 hole spinnerette | | | |
|---|---|---|---|---|
| Experiment No: | 1 | 2 | 3 | 4 |
| Spinnerette Temperature, °F | 610 → | | | |
| Spinning Rate, gram/min | 64.0 → | | | |

-continued

| Polyester, 48 hole spinnerette | | | | |
|---|---|---|---|---|
| Experiment No: | 1 | 2 | 3 | 4 |
| Quench air temperature, °F | 70 → | | | |
| Yarn velocity (roll "A") m/min | 4120 | 4120 | 4120 | 4120 |
| Yarn velocity (roll "B") m/min | 4182 | 4166 | 4128 | 4120 |
| Roll A and B diameter, inches | 1 | 1 | 1 | 1 |
| Roll A, RPM | 51500 | 51500 | 51500 | 51500 |
| Roll B, RPM | 52270 | 52070 | 51600 | 51500 |
| Roll C, m/min | 4184 | 4170 | 4130 | 4124 |
| % stretch | 1.5 | 1.1 | 0.2 | 0 |
| Roll A Temperature °F | 600 | 400 | 200 | 70 |
| denier per filament (on roll "A") ("dpf") | 2.91 → | | | |
| wrap angle (over roll "A") | 90 → | | | |
| contact length, cm | 2.00 → | | | |
| contact time, sec. · $10^{-4}$ ("t") | 2.91 → | | | |
| t/dpf · $10^{-4}$ | 1.00 → | | | |
| Birefringence (Δ n) | 0.010 → | | | |
| Crimp Development | 5 | 2 | 1 | 0 |

EXAMPLE 8

| Polyester, 48 hole spinnerette | | | | |
|---|---|---|---|---|
| Experiment No: | 1 | 2 | 3 | 4 |
| Spinnerette Temperature, °F | 610 → | | | |
| Spinning Rate, gram/min | 64.0 → | | | |
| Quench Air temperature, °F | 70 | 200 | 400 | 600 |
| Yarn velocity (roll "A") m/min | 4120 | 4108 | 4095 | 4084 |
| Yarn velocity (roll "B") m/min | 4182 | 4182 | 4182 | 4182 |
| Roll A and B diameter, inches | 1 | 1 | 1 | 1 |
| Roll A, RPM | 51500 | 51340 | 51190 | 51040 |
| Roll B, RPM | 52270 | 52270 | 52270 | 52270 |
| Roll C, m/min | 4185 | 4185 | 4185 | 4185 |
| % stretch | 1.5 | 1.8 | 2.1 | 2.4 |
| Roll A temperature °F | 600 → | | | |
| denier per filament (on roll "A") ("dpf") | 2.91 | 2.92 | 2.93 | 2.94 |
| wrap angle (over roll "A") | 90 → | | | |
| contact length, cm | 2.00 → | | | |
| contact time, sec. · $10^{-4}$ ("t") | 2.91 | 2.92 | 2.93 | 2.94 |
| t/dpf · $10^{-4}$ | 1.00 | 1.00 | 1.00 | 1.00 |
| Birefringence (Δ n) | 0.0100 | .0080 | .0045 | .0025 |
| Crimp Development | 5 | 4 | 1 | 0 |

EXAMPLE 9

The purpose of this example is to demonstrate the importance of the grooved roll contact time in relation to dpf (denier per filament) and texturing intensity for the polypropylene. Profax 6423, a product of Hercules Inc., was extruded at a spinnerette temperature of 280°C. Groove distance on the grooved roll was 230 microns. The draw ratio was 2.8.

| Experiment | 1 | 2 | 3 | 4 | 5 | 6 |
|---|---|---|---|---|---|---|
| Resin throughput g/min | 2.2 | 4.4 | 44 | 37.7 | 75.4 | 70.9 |
| number of filaments | 35 | 35 | 35 | 17 | 17 | 8 |
| dpf | 15 | 15 | 15 | 15 | 30 | 60 |
| Feed roll speed m/min | 75.3 | 150.7 | 754 | 1330 | 1330 | 1330 |
| grooved roll diameter (cm) | 2.54 | 2.54 | 1.27 | 1.27 | 1.27 | 1.27 |
| wrap angle of yarn (degree) | 170 | 170 | 170 | 60 | 60 | 60 |
| contact time (seconds) "t" | 0.030 | 0.015 | 0.0015 | 0.0003 | 0.0003 | 0.0003 |
| t/dpf. $10^4$ | 20 | 10 | 1.0 | 0.2 | 0.1 | 0.05 |
| | 0.002 | 0.001 | 0.0001 | 0.00002 | 0.00001 | 0.000005 |
| Texturing intensity | 0 | 1 | 5 | 4 | 2 | 0 |

According to this table the workable $t$/dpf range lies between 0.002 and 0.00002 seconds.

EXAMPLE 10

The experiment number 3, of Example 9 was repeated, with the exception of the grooved roll temperature, which was varied in this series.

TABLE 10

| Grooved roll temperature (°C) | 70 | 100 | 150 | 200 | 250 | 280 |
|---|---|---|---|---|---|---|
| Texturing intensity | 0 | 2 | 5 | 5 | 5 | —(yarn melting on roll) |

For polypropylene, the grooved roll temperature should be above 100 degrees Centigrade, but lower than 280°C to avoid melting of filaments.

EXAMPLE 11

The previous Examples, 1 and 8 showed that there is a relation between birefringence and stretch in regard to texturing intensity. Especially yarns drawn over the grooved roll at very low percentages show a sensitivity to the degree of melt orientation as measured by birefringence.

Example 11 has been run to define accurately the limits of stretch and orientation necessary to produce an acceptable level of texture or crimp.

Polypropylene yarn of various degrees of melt orientation was produced as feed yarn for the drawing experiments described in the table below. The yarn (polymer as in Example 1) was not mechanically drawn, but merely would at different speeds to produce different levels of melt orientation and birefringence: a winding speed of 2000, 1200, 800, 300 and 100 meter/minute produced yarn of 0.0125, 0.0068, 0.0041, 0.0022 and 0.0009 birefringence as measured with an interference microscope according to the procedure described in an article by Heyn, Textile Research Journal, 22, 513 (1952). Yarns of 15 denier per filament, 35 filaments per bundle, were produced and fed to a yarn draw apparatus as shown in FIG. 5, capable to apply a fixed mechanical draw ratio. The grooved roll temperature was kept at 190°C, the feed roll speed at 754 meters/minute. A grooved roll of 1.27 cm diameter and 230 micron groove distance was used. The yarn wrap angle was 170°. Under these conditions, the $t$/dpf factor was constant for all experiments at 0.0001.

TABLE 11

| Birefringence $(\Delta n) \cdot 10^4$ | 125 | 68 | 41 | 22 | 9 |
|---|---|---|---|---|---|
| % Stretch**/Texturing intensity | 1.8/4 | 1.2/4 | 2.2/4 | 5.0/5 | 20/5 |
| | 1.0/4 | 1.0/4 | 1.8/4 | 2.5/4 | 10/5 |
| | 0.5/2 | 0.5/2 | 1.2/2 | 2.2/1 | 6/2 |
| | 0.3/1 | 0.4/1 | 1.0/1 | 1.8/0 | 5.0/1 |
| | 0.1/0 | 0.3/0 | 0.5/0 | 1.2/0 | 4.0/0 |

**% stretch = (draw roll speed − feed roll speed) × 100 / feed roll speed

In Table 11, for column 125, 1.8 is the percent stretch and 4 represents the texturing intensity.

These data are plotted on FIG. 9. FIG. 9 is a plot of data from Table 11 on a log-log scale with the birefringence $\Delta N$ and % stretch. The data with texturing intensity of 2 to 5 are indicated as "acceptable" with a circle; the data with texturing intensity 0–1 as "unacceptable" with an X. The curve 31 dividing the acceptable and unacceptable range fits the equation:

birefringence = 0.012 /(2 × % stretch + 1) or

% stretch = (0.006/birefringence) −0.5 which has been found empirically.

This means that at low levels of stretch, the yarns have to have a minimum level of birefringence or molecular orientation which is approximately inversely proportional to stretch, in order to produce an acceptable level of texturing intensity. In other words, at very low levels of stretch, the yarn must have a critical amount of pre-orientation in order to crimp. At less than 0.3% stretch, no crimp occurs.

At low stretch ratios, birefringence is very critical. At higher stretch ratios, birefringence is not critical. Commercially, it is not feasible to make yarn with a birefringence of less than 0.001 because this would require very slow spinning speeds.

I claim:

1. A method of forming latent crimp in synthetic thermoplastic addition polymers such as polyethylene and polypropylene, comprising the steps of:

A. Heating discrete spaced zones on one side of molecularly orientable filaments, to a temperature from about 100°to about 280°C for a time in seconds which is equal to X times denier per filament, where X is a value which falls within the range of 0.001 to 0.00001 and wherein the centers of said zones are spaced from 2 to 50 times the filament thickness, said heating of said zones being effected by guiding the filaments about a rotating heated grooved roll having circumferentially spaced lands generally parallel to the roll axis with the lands spaced 2 to 50 times the thickness of the filament;

B. Subsequently subjecting said filaments to molecular orientation by stretching them to a percent stretch which is at least (0.006/birefringence) − 0.5, by guiding the filaments at a first velocity rate over the grooved roll and drawing the filaments away from the grooved roll at a faster second rate.

2. The method of claim 1 wherein the filaments are drawn near the point of tangential departure from the grooved roll by impingement of a stream of hot fluid on the filaments, the stream having a velocity of at least 50 meters per second.

3. The method of claim 2 wherein the temperature of said fluid is at least 70°C but less than a temperature that would melt the filaments.

4. The method of claim 1 including the subsequent step of developing the latent crimp by heating the filaments to a temperature sufficient to develop the crimps while the filaments are under a low enough tension to allow the crimps to form.

5. The method of claim 1 including the intermediate step of cooling the filaments prior to developing the crimps.

6. A method of forming latent crimp in synthetic thermoplastic addition polymers such as polyethylene and polyproplyene, comprising the steps of:

A. Heating discrete spaced zones on one side of molecularly orientable filaments, to a temperature from about 100° to about 280°C for a time in seconds which is equal to X times denier per filament, where X is a value which falls within the range of 0.001 to 0.00001,and wherein the centers of said zones are spaced from 2 to 50 times the filament thickness, said heating of said zones being effected by guiding the filaments about a heated roll;

B. Subsequently subjecting said filaments to molecular orientation by stretching them to a percent stretch which is at least (0.006/birefringence) − 0.5, by guiding the filaments at a first velocity rate over the roll and drawing the filaments away from the roll at a faster second rate.

7. The method of claim 6 wherein the filaments are drawn near the point of tangential departure from the grooved roll by impingement of a stream of hot fluid on the filaments, the stream having a velocity of at least 50 meters per second.

8. The method of claim 7 wherein the temperature of said fluid is at least 70°C but less than a temperature that would melt the filaments.

9. The method of claim 6 including the subsequent step of developing the latent crimp by heating the filaments to a temperature sufficient to develop the crimps while the filaments are under a low enough tension to allow the crimps to form.

10. The method of claim 6 including the intermediate step of cooling the filaments prior to developing the crimps.

11. The method of claim 6 wherein said roll has a surface finish of more than 10 micro inches.

* * * * *